US009055831B2

(12) United States Patent
Chen

(10) Patent No.: US 9,055,831 B2
(45) Date of Patent: Jun. 16, 2015

(54) BOWL HAVING ARRANGEMENT FOR ADJUSTABLY FASTENING A MAGNET

(71) Applicant: Chin Chuan Chen, Taichung (TW)

(72) Inventor: Chin Chuan Chen, Taichung (TW)

( * ) Notice: Subject to any disclaimer, the term of this patent is extended or adjusted under 35 U.S.C. 154(b) by 131 days.

(21) Appl. No.: 13/892,302

(22) Filed: May 12, 2013

(65) Prior Publication Data

US 2014/0332538 A1 Nov. 13, 2014

(51) Int. Cl.
*A47G 19/00* (2006.01)
*A47G 19/02* (2006.01)

(52) U.S. Cl.
CPC ..... *A47G 19/02* (2013.01); *Y10S 206/818* (2013.01)

(58) Field of Classification Search
CPC . A47G 19/02; A47G 2200/106; A47G 19/10; A47G 2023/0666; Y10S 206/818; Y10S 215/90
USPC ..... 206/818; 202/503–505, 527, 529, 202/628–630, 636, 288
See application file for complete search history.

(56) References Cited

U.S. PATENT DOCUMENTS 5,405,004 A * 4/1995 Vest et al. ..... 206/350
6,065,632 A * 5/2000 Moore, Jr. ..... 220/483
6,135,307 A * 10/2000 Fahy ..... 220/574
6,164,473 A * 12/2000 Waldrip ..... 215/378

* cited by examiner

*Primary Examiner* — Sarah B McPartlin

(57) ABSTRACT

A bowl includes a flexible, continuous wall; an annular latch disposed on a lower portion of an inner surface of the flexible, continuous wall and inclined downward, inward; a hollow bottom member integrally formed with the flexible, continuous wall; a magnet disposed in the hollow bottom member; an annular groove formed between the annular latch and a joining portion of the inner surface of the flexible, continuous wall and an inner surface of the hollow bottom member; an internally threaded boss disposed on a bottom of the hollow bottom member; and a cover including an externally threaded projection threadedly fastened in the internally threaded boss. An edge of the cover is disposed in the annular groove. A portion of top of the cover adjacent to its edge is urged downward by the annular latch so as to hold the magnet secure.

1 Claim, 5 Drawing Sheets

BOWL HAVING ARRANGEMENT FOR ADJUSTABLY FASTENING A MAGNET

BACKGROUND OF THE INVENTION

1. Field of the Invention

The invention relates to bowl and more particularly to a bowl having an arrangement for adjustably fastening a magnet in a bottom so that a replacement of the magnet is made easy if such need arises.

2. Description of Related Art

A conventional bowl 10 is shown in FIG. 1 and comprises a continuous wall 11, a hollow bottom member 12 integrally formed with the wall 11, a disc shaped cover 14 having an annular projecting edge 142 fitted in an annular groove 15 on a joining portion of inner surfaces of the wall 11 and the bottom member 12, and a ring shaped magnet 13 in the space of the bottom member 12. The bottom 131 of the magnet 13 and the bottom 121 of the bottom member 12 are adhesively fastened together. Further, the bottom 141 of the cover 14 and the top 132 of the magnet 13 are also adhesively fastened together.

However, a replacement of the magnet 13 can be very difficult and time consuming if such need arises due to the adhesively fastened arrangements. Thus, the need for improvement still exists.

SUMMARY OF THE INVENTION

It is therefore one object of the invention to provide a bowl comprising a flexible, continuous wall; an annular latch disposed on a lower portion of an inner surface of the flexible, continuous wall and inclined downward, inward; a hollow bottom member integrally formed with the flexible, continuous wall; a magnet disposed in the hollow bottom member; an annular groove formed between the annular latch and a joining portion of the inner surface of the flexible, continuous wall and an inner surface of the hollow bottom member; an internally threaded boss disposed on a bottom of the hollow bottom member; and a cover including an externally threaded projection threadedly fastened in the internally threaded boss; wherein an edge of the cover is disposed in the annular groove, and a portion of the cover adjacent to its edge is urged downward by the annular latch so as to hold the magnet secure.

The above and other objects, features and advantages of the invention will become apparent from the following detailed description taken with the accompanying drawings.

DETAILED DESCRIPTION OF THE INVENTION

Figure 1:
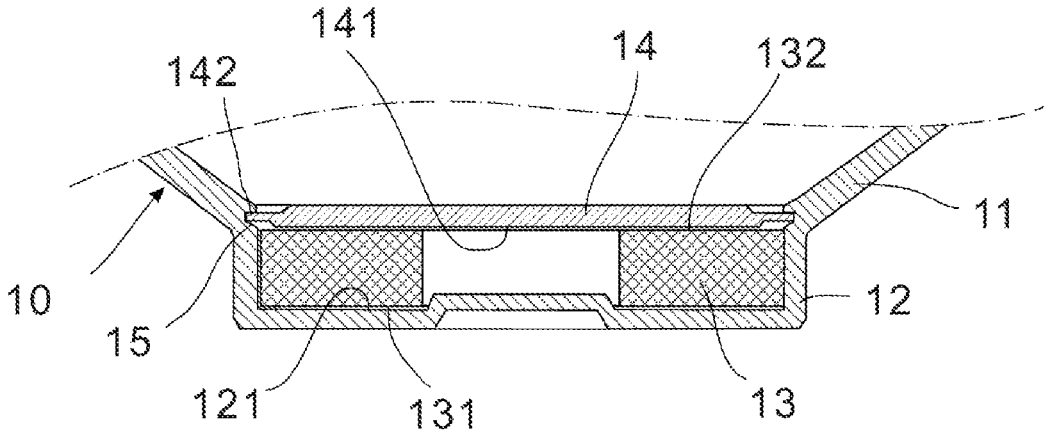
FIG. 1 Prior Art
FIG. 1 is a longitudinal sectional view of a conventional bowl.
Figure 2:
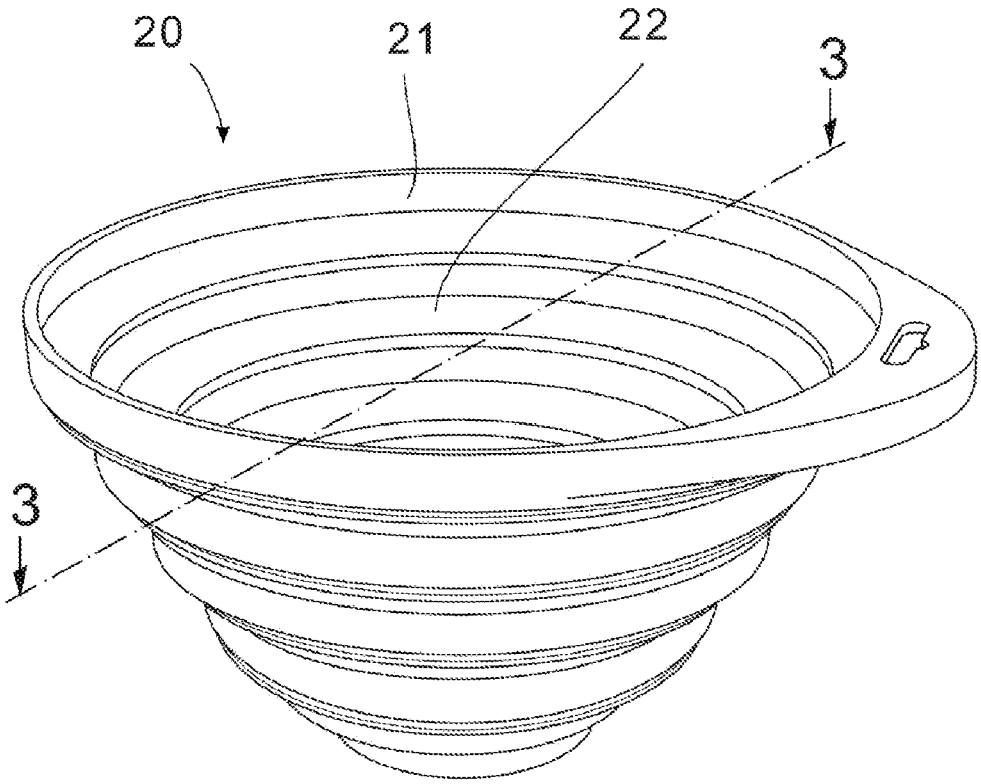
FIG. 2 is a perspective view of a bowl according to the invention.
Figure 3:
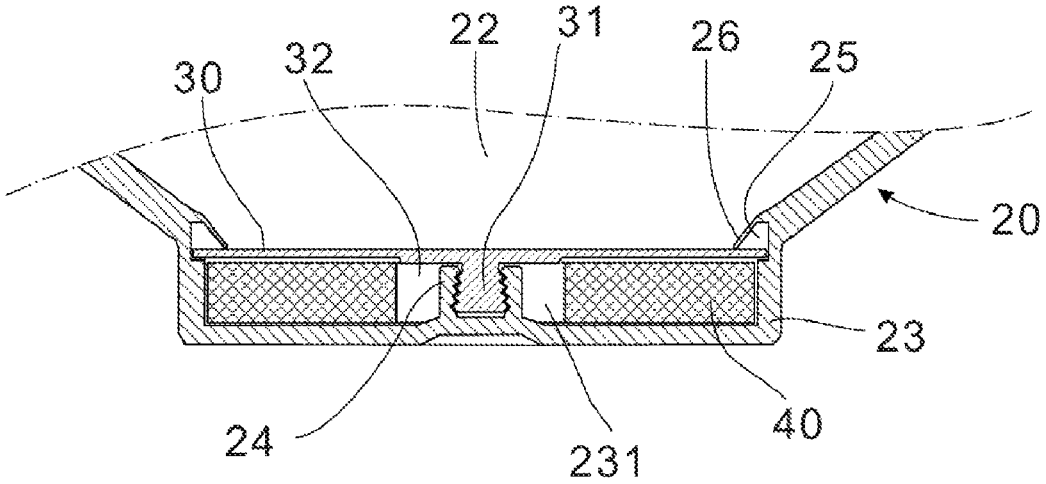
FIG. 3 is a longitudinal sectional view taken along line 3-3 of FIG. 2 with a first magnet disposed in the hollow bottom member in a configuration of the invention.
Figure 5:
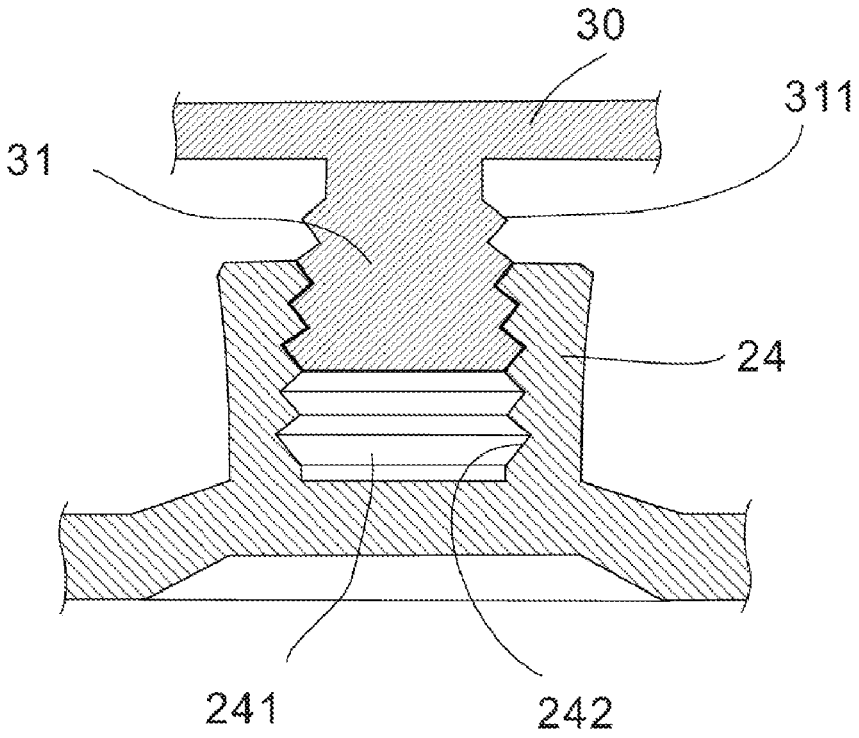
FIG. 5 is an enlarged view of the central portion of the bowl of FIG. 4.

Referring to FIGS. 2, 3, and 5, a bowl 10 in accordance with the invention comprises the following components as discussed in detail below.

A flexible, continuous wall 21 is provided. A hollow bottom member 23 is integrally formed with the flexible, continuous wall 21. A disc shaped cover 30 is provided on top of the bottom member 23 and is substantially flush with a joining portion of inner surfaces of the flexible, continuous wall 21 and the bottom member 23. A space 22 is defined by the flexible, continuous wall 21 and the cover 30 and is adapted to store a number of small ferromagnetic articles (not shown). A ring shaped first magnet (e.g., ferrite magnet) 40 is disposed in a space 231 of the bottom member 23. A boss 24 is provided on a bottom of the bottom member 23 and is about flush with the joining portion of inner surfaces of the flexible, continuous wall 21 and the bottom member 23. The boss 24 includes a hole 241 having internal threads 242. An annular latch 26 is provided on the bottom edge of the inner surface of the flexible, continuous wall 21. An annular groove 25 is formed between the annular latch 26 and the joining portion of the inner surfaces of the flexible, continuous wall 21 and the bottom member 23. The bottom edge of the annular latch 26 is urged against the top of the cover 30. The cover 30 includes a projection 31 on a center of the underside. The projection 31 includes external threads 311 threadedly secured to the internal threads 242 by driving into the hole 241. The annular edge of the cover 30 is disposed in the groove 25. As such, the first magnet 40 is fitted in the space 231. Further, the cover 30 is adjustably fastened by the boss 24 and the annular latch 26.

Figure 4:
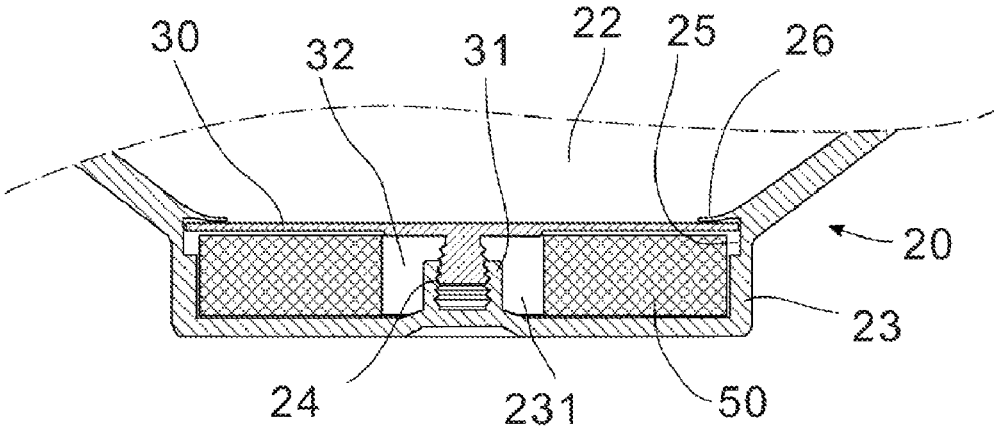
FIG. 4 is a view similar to FIG. 3 showing a second magnet having a height greater than the height of the first magnet disposed in the hollow bottom member in another configuration of the invention.

Referring to FIG. 4 in conjunction with FIGS. 2, 3, and 5, the first magnet 40 is replaced by a second magnet (e.g., Neodymium-iron-boron (NIB) magnet) 50. The second magnet 50 is higher than the first magnet 40. Thus, less portion of the projection 31 is disposed in the hole 241. The annular latch 26 is flexibly urged upward by the cover 30. Likewise, the cover 30 is adjustably fastened by the boss 24 and the annular latch 26.

It is envisaged by the invention that replacement of either the first magnet 40 or the second magnet 50 is made easy by detaching the projection 31 from the hole 241.

While the invention has been described in terms of preferred embodiments, those skilled in the art will recognize that the invention can be practiced with modifications within the spirit and scope of the appended claims.

What is claimed is:

1. A bowl comprising:

a flexible, continuous wall;

an annular latch disposed on a lower portion of an inner surface of the flexible, continuous wall and inclined downward, inward;

a hollow bottom member integrally formed with the flexible, continuous wall;

a magnet disposed in the hollow bottom member;

an annular groove formed between the annular latch and a joining portion of the inner surface of the flexible, continuous wall and an inner surface of the hollow bottom member;

an internally threaded boss disposed on a bottom of the hollow bottom member; and a cover including an externally threaded projection threadedly fastened in the internally threaded boss;

wherein an edge of the cover is disposed in the annular groove; and wherein a portion of a top of the cover adjacent to its edge is urged downward by the annular latch so as to hold the magnet secure.

* * * * *